US010808196B2

(12) United States Patent
Lewis

(10) Patent No.: US 10,808,196 B2
(45) **Date of Patent: *Oct. 20, 2020**

(54) COLD CRANKING SIMULATOR VISCOSITY REDUCING BASE STOCKS AND LUBRICATING OIL FORMULATIONS CONTAINING THE SAME

(71) Applicant: ExxonMobil Chemical Patents Inc., Baytown, TX (US)

(72) Inventor: Kyle G. Lewis, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 84 days.

This patent is subject to a terminal disclaimer.

(21) Appl. No.: 15/925,937

(22) Filed: Mar. 20, 2018

(65) Prior Publication Data

US 2018/0282651 A1 Oct. 4, 2018

Related U.S. Application Data

(60) Provisional application No. 62/477,738, filed on Mar. 28, 2017.

(51) Int. Cl.
*C10M 111/02* (2006.01)
*C10M 105/34* (2006.01)
(Continued)

(52) U.S. Cl.
CPC ..... *C10M 111/02* (2013.01); *C10M 101/00* (2013.01); *C10M 105/34* (2013.01);
(Continued)

(58) Field of Classification Search
CPC ..... C10N 2240/10; C10N 2230/02; C10N 2230/74; C10N 2030/74; C10N 2040/25;
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A 1/1981
EP 0089709 A1 9/1983
(Continued)

OTHER PUBLICATIONS

Lewis, K.G. et al., U.S. Appl. No. 15/904,629, filed Feb. 26, 2018, entitled "Cold Cranking Simulator Viscosity Boosting Base Stocks and Lubricating Oil Formulations Containing the Same".
(Continued)

*Primary Examiner* — Vishal V Vasisth

(57) ABSTRACT

This disclosure relates to cold cranking simulator viscosity ("CCSV") reducing base stocks that allow flexibility for low viscosity SAE engine oil grades (e.g., 5W and 0W) to meet demanding low temperature viscosity requirements while maintaining a higher base oil viscosity for improved wear protection. The CCSV-reducing base stocks include monoesters derivable from a Guerbet alcohol and a monocarboxylic acid. The disclosure also relates to lubricating oils containing the CCSV-reducing base stocks, and a method for improving fuel efficiency and/or wear protection in an engine by using as the lubricating engine oil a formulated oil containing one or more of the CCSV-reducing base stocks.

18 Claims, 2 Drawing Sheets

(51) Int. Cl.

| | |
|---|---|
| ***C10M 101/00*** | (2006.01) |
| ***C10M 129/70*** | (2006.01) |
| *C10N 20/00* | (2006.01) |
| *C10N 30/02* | (2006.01) |
| *C10N 30/06* | (2006.01) |
| *C10N 30/00* | (2006.01) |
| *C10N 40/25* | (2006.01) |
| *C10N 20/04* | (2006.01) |

(52) U.S. Cl.
CPC .... *C10M 129/70* (2013.01); *C10M 2203/003* (2013.01); *C10M 2205/0285* (2013.01); *C10M 2207/281* (2013.01); *C10M 2207/2815* (2013.01); *C10N 2020/04* (2013.01); *C10N 2020/071* (2020.05); *C10N 2030/02* (2013.01); *C10N 2030/06* (2013.01); *C10N 2030/54* (2020.05); *C10N 2030/74* (2020.05); *C10N 2040/25* (2013.01)

(58) Field of Classification Search
CPC .... C10M 2203/022; C10M 2207/2815; C10M 2207/325; C10M 2215/285; C10M 2203/065; C10M 2207/0406
See application file for complete search history.

(56) References Cited

U.S. PATENT DOCUMENTS 2,191,498 A 2/1940 Reiff
2,387,501 A 10/1945 Dietrich
2,655,479 A 10/1953 Munday et al.
2,666,746 A 1/1954 Munday et al.
2,721,877 A 10/1955 Popkin et al.
2,721,878 A 10/1955 Popkin
2,817,693 A 12/1957 Jacob et al.
3,036,003 A 5/1962 Arthur
3,087,936 A 4/1963 Le Suer
3,149,178 A 9/1964 Hamilton et al.
3,172,892 A 3/1965 Le Suer et al.
3,200,107 A 8/1965 Le Suer
3,219,666 A 11/1965 Norman et al.
3,250,715 A 5/1966 Wyman
3,254,025 A 5/1966 Le Suer
3,272,746 A 9/1966 Le Suer et al.
3,275,554 A 9/1966 Hendrik
3,316,177 A 4/1967 Dorer
3,322,670 A 5/1967 Burt et al.
3,329,658 A 7/1967 Fields
3,341,542 A 9/1967 Le Suer et al.
3,382,291 A 5/1968 Brennan
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 Van Der Voort et al.
3,454,607 A 7/1969 Le Suer et al.
3,519,565 A 7/1970 Coleman
3,541,012 A 11/1970 Stuebe
3,632,511 A 1/1971 Liao
3,565,804 A 2/1971 Honnen et al.
3,595,791 A 7/1971 Cohen
3,630,904 A 12/1971 Musser et al.
3,652,616 A 3/1972 Watson et al.
3,666,730 A 5/1972 Coleman
3,666,827 A 5/1972 Carlson et al.
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,742,082 A 6/1973 Brennan
3,751,365 A 8/1973 Piasek et al.
3,755,433 A 8/1973 Hellmuth
3,756,953 A 9/1973 Piasek et al.
3,769,363 A 10/1973 Brennan
3,780,128 A 12/1973 Shubkin
3,787,374 A 1/1974 Adams
3,798,165 A 3/1974 Piasek et al.
3,803,039 A 4/1974 Piasek et al.
3,822,209 A 7/1974 Knapp et al.
3,837,023 A 8/1974 Ladeur et al.
3,876,720 A 4/1975 Heilman et al.
3,948,800 A 4/1976 Meinhardt
4,100,082 A 7/1978 Clason et al.
4,149,178 A 4/1979 Estes
4,218,330 A 8/1980 Shubkin
4,234,435 A 11/1980 Meinhardt et al.
4,239,930 A 12/1980 Allphin et al.
4,367,352 A 1/1983 Watts et al.
4,413,156 A 11/1983 Watts et al.
4,426,305 A 1/1984 Malec
4,434,408 A 2/1984 Baba et al.
4,454,059 A 6/1984 Pindar et al.
4,594,172 A 6/1986 Sie
4,658,078 A 4/1987 Slaugh et al.
4,767,551 A 8/1988 Hunt et al.
4,798,684 A 1/1989 Salomon
4,827,064 A 5/1989 Wu
4,827,073 A 5/1989 Wu
4,897,178 A 1/1990 Best et al.
4,910,355 A 3/1990 Shubkin et al.
4,921,594 A 5/1990 Miller
4,943,672 A 7/1990 Hamner et al.
4,952,739 A 8/1990 Chen
4,956,122 A 9/1990 Watts et al.
4,975,177 A 12/1990 Garwood et al.
5,068,487 A 11/1991 Theriot
5,084,197 A 1/1992 Galic et al.
5,086,487 A 1/1992 Katayama et al.
5,264,642 A 11/1993 Wu
5,358,628 A 10/1994 Abelian et al.
5,366,648 A 11/1994 Salomon et al.
5,382,739 A 1/1995 Atkins et al.
5,430,105 A 7/1995 Redpath et al.
5,688,887 A 11/1997 Bagheri et al.
5,705,458 A 1/1998 Roby et al.
5,728,907 A 3/1998 Squicciarini et al.
6,034,039 A 3/2000 Gomes et al.
6,080,301 A 6/2000 Berlowitz et al.
6,090,989 A 7/2000 Trewella et al.
6,165,949 A 12/2000 Berlowitz et al.
6,346,504 B1 2/2002 Appelman et al.
6,992,049 B2 1/2006 Deckman et al.
7,687,445 B2 3/2010 Rosenbaum et al.
7,989,670 B2 8/2011 Wu et al.
8,921,291 B2 12/2014 Wu et al.
2003/0055184 A1 3/2003 Song et al.
2003/0191032 A1 10/2003 Deckman et al.
2004/0129603 A1 7/2004 Fyfe et al.
2006/0105920 A1 5/2006 Dalman et al.
2006/0172898 A1 8/2006 Roby et al.
2006/0247138 A1 11/2006 Rosenbaum et al.
2008/0020950 A1 1/2008 Gray et al.
2009/0036725 A1 2/2009 Wu et al.
2009/0181873 A1* 7/2009 Ryklin ..... A61K 8/39 510/123
2010/0261628 A1* 10/2010 Scherer ..... C10M 105/34 508/496
2011/0039740 A1 2/2011 Kitching et al.
2013/0023456 A1* 1/2013 Teshima ..... C10M 111/04 508/591
2013/0023705 A1* 1/2013 Teshima ..... C10M 111/04 585/13
2013/0030226 A1* 1/2013 Teshima ..... C10M 169/041 585/13
2013/0090273 A1 4/2013 Martin et al.
2013/0090277 A1* 4/2013 Martin ..... C10M 169/04 508/459
2013/0902077 4/2013 Martin et al.

(56) References Cited

U.S. PATENT DOCUMENTS

| | | | | |
|---|---|---|---|---|
| 2015/0094242 | A1* | 4/2015 | Sanchez | C10M 177/00 508/110 |
| 2015/0119303 | A1* | 4/2015 | Guerin | C10M 145/00 508/287 |
| 2015/0126419 | A1* | 5/2015 | Lerasle | C10M 161/00 508/364 |
| 2015/0344805 | A1* | 12/2015 | Dance | C10M 157/04 508/293 |
| 2016/0237375 | A1 | 8/2016 | Hogendoorn | |
| 2016/0319215 | A1 | 11/2016 | Hirooka et al. | |
| 2017/0183594 | A1 | 6/2017 | Courtiade et al. | |
| 2017/0226441 | A1 | 8/2017 | Courtiade et al. | |
| 2018/0112148 | A1 | 4/2018 | Bouvier et al. | |

FOREIGN PATENT DOCUMENTS

| | | | |
|---|---|---|---|
| EP | 464546 | A1 | 1/1992 |
| EP | 1472330 | A1 | 12/2002 |
| GB | 1350257 | A | 4/1974 |
| GB | 1390359 | A | 4/1975 |
| GB | 1440230 | A | 6/1976 |
| JP | 2014139306 | A | 7/2014 |
| WO | 2004/033606 | A | 4/2004 |
| WO | 2004/033606 | A1 | 4/2004 |
| WO | 2007/002005 | A | 1/2007 |
| WO | 2009/130445 | A | 10/2009 |
| WO | 2017/097645 | A | 6/2017 |

OTHER PUBLICATIONS

Lewis, K.G., U.S. Appl. No. 15/904,703, filed Feb. 26, 2018, entitled "Cold Cranking Simulator Viscosity Boosting Base Stocks and Lubricating Oil Formulations Containing the Same".

Lewis, K.G. et al., U.S. Appl. No. 15/904,727, filed Feb. 26, 2018, entitled "Cold Cranking Simulator Viscosity Boosting Base Stocks and Lubricating Oil Formulations Containing the Same".

Lewis, K.G., U.S. Appl. No. 62/477,759, filed Mar. 28, 2017, entitled "Cold Cranking Simulator Viscosity Reducing Base Stocks and Lubricating Oil Formulations Containing the Same".

Henderson, "Gas to Liquids", Synthetics, Mineral Oils, and Bio-Based Lubricants: Chemistry and Technology, Second Edition, Chapter 19, 2013, pp. 333-346.

Kajdas et al., "Antiwear properties and tribochemical reactions of esters of palmitic acid and aliphatic alcohols in the steel-on-steel friction systems", Tribologia, vol. 29, pp. 389-402, 1998.

Anastopoulos et al., "Lubrication Properties of Low-Sulfur Diesel Fuels in the Presence of Specific Types of Fatty Acid Derivatives", Energy & Fuels, vol. 15, pp. 106-112, 2001.

Onopchenko et al., "Tetraalkylsilanes via Hydrosilylation of 1-Alkenes", Journal of Chemical Eng. Data, vol. 33, pp. 64-66, 1988.

Singh et al., "Tribological Behavior of Some Hydrocarbon Compounds and Their Blends", Wear, vol. 139, pp. 425-437, 1990.

The International Search Report and Written Opinion of PCT/US2018/023922 dated Jul. 16, 2018.

* cited by examiner

COLD CRANKING SIMULATOR VISCOSITY REDUCING BASE STOCKS AND LUBRICATING OIL FORMULATIONS CONTAINING THE SAME

CROSS-REFERENCE OF RELATED APPLICATIONS

This application claims the benefit of Provisional Application No. 62/477,738, filed Mar. 28, 2017, the disclosures of which is incorporated herein by reference.

FIELD OF THE INVENTION

This disclosure relates to cold cranking simulator viscosity ("CCSV") reducing base stocks that allow flexibility for low viscosity SAE engine oil grades (e.g., 5W and 0W) to meet demanding low temperature viscosity and high temperature viscosity requirements, lubricating oil formulations containing the CCSV-reducing base stocks, and a method for improving fuel efficiency and/or wear protection in an engine by using as the engine oil a lubricating oil formulation containing one or more of the CCSV-reducing base stocks.

BACKGROUND OF THE INVENTION

Increased regulatory pressure to improve fuel efficiency and reduce carbon emissions is shifting the automotive industry toward use of lower viscosity grade engine oils. Lower viscosity engine oils promise to maximize fuel economy, but the thinner oils can negatively impact wear protection in automotive engines. This is particularly true for heavy duty engine oils in commercial vehicles which, due to more severe loads and operating conditions, require lubricants with enhanced wear and deposit protection.

Today, 15W and 10W grade engine oils make up the largest portion of the commercial vehicle lube market. Increased fuel efficiency requirements will drive growth in the lower viscosity 5W and 0W grade engine oils market. At the same time, demands on engine oil durability and wear protection will continue to increase.

Automotive engine oils conform to the SAE J300 metric for grading engine oil viscosity. For each SAE engine oil grade, (e.g., 5W-30, 10W-30, etc.) there are maximum and minimum viscosity requirements at both high and low temperatures. Typically, such high temperature viscosity requirements are typically expressed as a permitted range of kinematic viscosity at 100° C. determined pursuant to ASTM D445 ("KV100"), and such low temperature viscosity requirements are expressed as a permitted range of cold cranking simulator viscosity determined pursuant to ASTM D5583.

Within a particular engine oil grade, it is theoretically possible to maximize wear performance by increasing the KV100 of the engine oil to the allowable maximum. In practice, it is difficult to achieve the maximum allowable KV100 in an engine oil, especially those of a 0W or 5W grade, and still meet the demanding CCSV requirements. Often, high levels of low viscosity hydrocarbon base stocks are needed to meet the low temperature viscosity requirements of a 0W or 5W engine oil. This can negatively impact wear performance.

There is a need for an engine oil that exhibits a desirable KV100 and an acceptable CCSV permitted by the SAE grade designations. Particularly, there is a need of a base stock material capable of providing the desired KV100 and needed CCSV profiles to the oil formulation permitted by a SAE grade designation. There is also a need for a method for determining the efficacy of a base stock as a CCSV-reducing base stock.

The present invention meets this and other needs.

SUMMARY OF THE INVENTION

It has been found that a category of mono-ester derived from Guerbet alcohol and monocarboxylic acid can be used effectively as a CCSV-reducing base stock to reduce the CCSV of an oil composition while not significantly impacting the KV100 of the oil composition, making them particularly useful in formulating SAE J300 conforming engine oils.

A first aspect of the present disclosure relates to an oil composition consisting of a first base stock and a reference oil, wherein: (a) the first base stock comprises a mono-ester having the following formula:

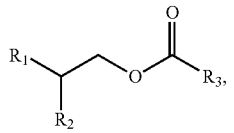

where $R_1$ and $R_2$ are independently each a substituted or unsubstituted C2-C30 alkyl group, and $R_3$ is a substituted or unsubstituted C2-C20 alkyl group; (b) the first base stock is present in the oil composition at a concentration in a range from 0.5 wt % to 14.5 wt %, based on the total weight of the oil composition; (c) the oil composition has a kinematic viscosity at 100° C. pursuant to ASTM D445 ("KV100") of KV100(oil) and a cold cranking simulator viscosity at a given temperature pursuant to ASTM 5293 ("CCSV") of CCSV(oil); (e) the reference oil has a KV100 and CCSV of KV100(ref) and CCSV(ref), respectively, and the following conditions (i) and (ii) are met:

$$-20 \le D(kv) = \frac{KV100(\text{oil}) - KV100(ref)}{KV100(ref)} \times 100 \le 40; \text{ and} \quad \text{(i)}$$

$$-1000 \le D(ccsv) = \frac{CCSV(\text{oil}) - CCSV(ref)}{CCSV(ref)} \times 100 < 0. \quad \text{(ii)}$$

A second aspect of the present disclosure relates to the use of a mono-ester having the following formula as a first base stock in a lubricating oil composition at a concentration thereof in the range from 0.5 to 14.5 wt % based on the total weight of the lubricating oil composition:

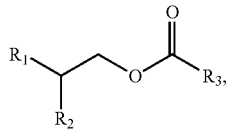

where $R_1$ and $R_2$ are independently each a substituted or unsubstituted C2-C30 alkyl group, and $R_3$ is a substituted or unsubstituted C2-C20 alkyl group.

A third aspect of the present disclosure relates to a method for improving fuel efficiency and/or wear protection in an engine, comprising lubricating the engine by an engine oil comprising an oil composition of the first aspect of the present disclosure.

Further objects, features and advantages of the present disclosure will be understood by reference to the following drawings and detailed description.

DETAILED DESCRIPTION OF THE INVENTION

Definitions

Figure 1:
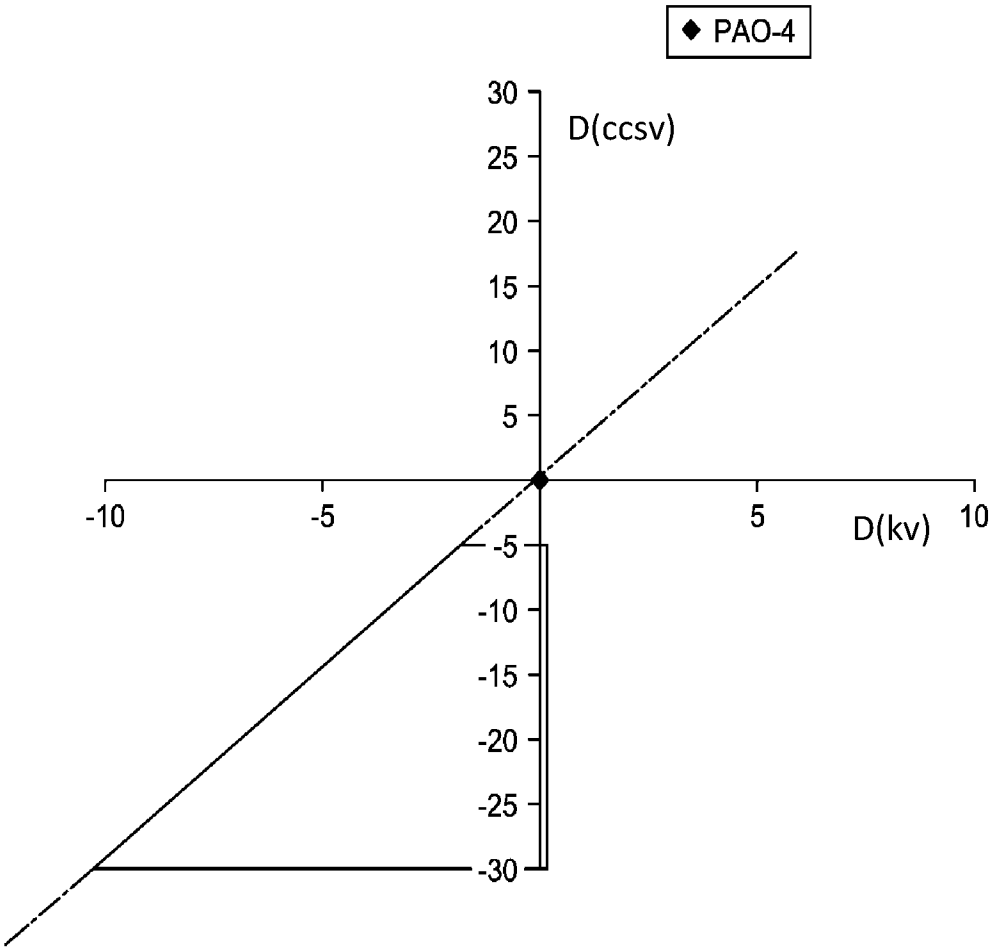
FIG. 1 is a diagram showing the impact of the CCSV-reducing base stock on CCSV and KV100 of a formulation consisting of a reference oil and the CCSV-reducing base stock.

"Alkyl group" refers to a saturated hydrocarbyl group consisting of carbon and hydrogen atoms.

"Hydrocarbyl group" refers to a group consisting of hydrogen and carbon atoms only. A hydrocarbyl group can be saturated or unsaturated, linear or branched linear, cyclic or acyclic, aromatic or non-aromatic.

"Cn" group or compound refers to a group or a compound comprising carbon atoms at total number thereof of n. Thus, "Cm-Cn" group or compound refers to a group or compound comprising carbon atoms at a total number thereof in the range from m to n. Thus, a C1-C50 alkyl group refers to an alkyl group comprising carbon atoms at a total number thereof in the range from 1 to 50.

"Carbon backbone" refers to the longest straight carbon chain in the molecule of the compound or the group in question. "Branches" refer to any non-hydrogen group connected to the carbon backbone.

"Mono-ester" refers to a compound having one ester (—C(O)—O—) functional group therein.

"Tertiary amide" refers to a compound comprising a tertiary amide (>N—C(O)—) functional group therein.

"SAE" refers to SAE International, formerly known as Society of Automotive Engineers, which is a professional organization that sets standards for internal combustion engine lubricating oils.

"SAE J300" refers to the viscosity grade classification system of engine lubricating oils established by SAE, which defines the limits of the classifications in rheological terms only.

"Lubricating oil" refers to a substance that can be introduced between two or more surfaces and lowers the level of friction between two adjacent surfaces moving relative to each other. A lubricant "base stock" is a material, typically a fluid at various levels of viscosity at the operating temperature of the lubricant, used to formulate a lubricant by admixing with other components. Non-limiting examples of base stocks suitable in lubricants include API Group I, Group II, Group III, Group IV, and Group V base stocks. PAOs, particularly hydrogenated PAOs, have recently found wide use in lubricant formulations as a Group IV base stock, and are particularly preferred. If one base stock is designated as a primary base stock in the lubricant, additional base stocks may be called a co-base stock.

All kinematic viscosity values in the present disclosure are as determined pursuant to ASTM D445. Kinematic viscosity at 100° C. is reported herein as KV100, and kinematic viscosity at 40° C. is reported herein as KV40. Unit of all KV100 and KV40 values herein is cSt unless otherwise specified.

All viscosity index ("VI") values in the present disclosure are as determined pursuant to ASTM D2270.

All Noack volatility ("NV") values in the present disclosure are as determined pursuant to ASTM D5800 unless specified otherwise. Unit of all NV values is wt %, unless otherwise specified.

All CCS viscosity ("CCSV") values in the present disclosure are as determined pursuant to ASTM 5293. Unit of all CCSV values herein is centipoise, unless specified otherwise. All CCSV values are measured at a temperature of interest to the lubricating oil formulation or oil composition in question. Thus, for the purpose of designing and fabricating engine oil formulations, the temperature of interest is the temperature at which the SAE J300 imposes a maximal CCSV. Thus, the CCSV measurement temperature is: −35° C. for a SAE 0W grade oil; −30° C. for a SAE 5W grade oil; −25° C. for a SAE 10W grade oil;

−20° C. for a SAE 15W grade oil; −15° C. for a SAE 20W grade oil; and −10° C. for a SAE 25W grade oil.

All percentages in describing chemical compositions herein are by weight unless specified otherwise. "Wt %" means percent by weight.

All numerical values within the detailed description and the claims herein are modified by "about" or "approximately" the indicated value, taking into account experimental error and variations that would be expected by a person having ordinary skill in the art.

I. CCSV-Reducing Base Stock

I.1 General

The base stock of the present disclosure desirably has a KV100 in the range from k1 to k2 cSt, where k1 and k2 can be, independently, 1.0, 1.5, 2.0, 2.5, 3.0, 3.5, 4.0, 4.5, 5.0, 5.5, 6.0, 6.5, 7.0, and 7.5, as long as $k1<k2$. Preferably $k1=3.0$, and $k2=6.0$. Therefore, the base stock of the present disclosure has a relatively "low" viscosity at the normal operating temperature of an internal combustion engine lubricating oil.

The base stock may desirably have a VI in the range from v1 to v2, where v1 and v2 can be, independently, 100, 110, 120, 130, 140, 150, 160, 170, 180, 190, and 200, as long as $v1<v2$.

The base stock of the present disclosure desirably has a NV value in the range from n1 to n2 wt %, where n1 and n2 can be, independently, 0.1, 0.5, 1, 2, 3, 4, 5, 6, 7, 8, 9, 10, 11, 12, 13, 14, 15, 16, 17, 18, 19, 20, as long as $n1<n2$. Preferably, $n1=1$, and $n2=16$. In general, for the same type of CCSV-reducing base stock, the larger the molecular weight of the molecule, the lower the NV value. For engine oils and base stocks for them, typically a low NV value is preferred, all other parameters held equal.

Desirably the CCSV-reducing base stock of the present disclosure has a high thickening effect at a relatively "low" temperature (e.g., −35° C.) that an automobile engine may experience from time to time during its normal life. The CCSV-reducing base stock of the present disclosure may therefore manifests itself as a solid, a wax, or a viscous fluid at −35° C., 0° C., and even 25° C.

The base stock of the present disclosure when incorporated into a lubricating oil formulation or an oil composition desirably results in a reduced CCSV of the formulation or oil composition compared to the remainder of the lubricating oil formulation or oil composition. Therefore, it is called a CCSV-reducing base stock. Such CCSV-reducing base stock of the present disclosure can be used as a primary base stock or a co-base stock in any lubricating oil compositions. Preferably, the CCSV-reducing base stock of the present disclosure (referred to as "the first base stock" sometimes) is used as a co-base stock in conjunction with a second base stock, which is a primary base stock. In certain applications, it may be desirable to include two or even more additional base stocks in the lubricating oil formulation or oil composition of the present disclosure, in addition to the CCSV-reducing base stock of the present disclosure. For the convenience of description, the CCSV-reducing base stock will hereinafter be merely referred to as a generic base stock, regardless of its primary base stock or co-base stock designation.

Desirably, the CCSV-reducing base stock is readily soluble in a low viscosity hydrocarbon base stock at ambient temperatures for a given treat rate.

The base stock of the present disclosure is preferably used for formulating automobile engine lubricating oils, preferably those meeting the SAE J300 classification standards. However, it is contemplated that the base stock of the present disclosure may be used to formulate other lubricating oils (e.g., automobile drive-line oils, industrial lubricating oils, gear oils, greases, and the like), heat transfer oils (e.g., transformer oils), hydraulic power transfer oils, processing oils, and the like.

I.2 Mono-Esters Derived from a Guerbet Alcohol and a Monocarboxylic Acid

Mono-esters derived from a Guerbet alcohol and a monocarboxylic acid are particularly advantageous CCSV-reducing base stocks of the present disclosure. The mono-esters have the following formula:

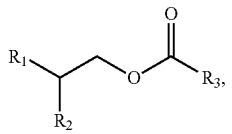

where $R_1$, $R_2$, and $R_3$ are independently each a C2-C30 substituted or unsubstituted alkyl group. Preferably, $R_1$, $R_2$, and $R_3$ are independently each a linear alkyl groups having 2 to 24 carbon atoms.

The mono-ester can be made by reacting a Guerbet alcohol having the formula

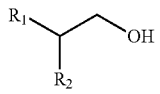

with a monocarboxylic acid having the formula

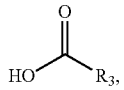

where $R_1$, $R_2$, and $R_3$ are as defined above, under reaction conditions sufficient to make the mono-ester. For example, by reacting 2-octyl-1-dodecanol with a linear C9 monocarboxylic acid, 2-octyldodecyl nonanoate can be made. Similarly, by reacting 2-octyl-1-dodecanol with a linear C12 monocarboxylic acid, 2-octyldodecyl dodecanoate can be made.

Illustrative mono-esters useful as CCSV-reducing base stock of this disclosure include, for example, 2-octyldodecyl nonanoate, 2-octyldodecyl dodecanoate, and mixtures thereof, and the like.

Illustrative Guerbet alcohols useful in preparing the mono-ester CCSV-reducing base stock of this disclosure include, for example, 2-octyl-1-dodecanol, and mixtures thereof, and the like.

The alcohol reactant is a mono-alcohol, preferably a single branched alcohol having 16 to 24 carbons. More preferably, the alcohol has 20 carbons. The preferred alcohol is a Guerbet alcohol.

The monocarboxylic acid is preferably a linear acid having 7 to 16 carbons. More preferably, the monocarboxylic acid has 9 to 12 carbons. Illustrative monocarboxylic acids useful in preparing the mono-ester CCSV-reducing base stock of this disclosure include, for example, linear C9 monocarboxylic acid (nonanoic acid), linear C10 monocarboxylic acid (decanoic acid), linear C11 monocarboxylic acid (undecanoic acid), linear C12 monocarboxylic acid (dodecanoic acid), and mixtures thereof, and the like.

II. Method for Determining CCSV-Reducing Efficacy of Base Stocks

Different base stocks can have different CCSV-reducing efficacy when used at different quantities relative to the same reference oil. The same base stock may have the same, similar or different CCSV-reducing efficacy with respect to different reference oils. The following method can be used for determining the efficacy of a particular first base stock at a given concentration in a lubricating oil to serve as a CCSV-reducing base stock.

The method comprises steps of determining the KV100 and CCSV at a low temperature of interest to the lubricating oil formulation or oil composition in question (such as the temperature at which the SAE J300 standard imposes a maximal CCSV requirement, i.e., −35° C. for an SAE 0W grade oil, −30° C. for an SAE 5W grade oil, −25° C. for an SAE 10W grade oil, −20° C. for an SAE 15W grade oil, −15° C. for an SAE 20 grade oil, and −10° C. for an SAE 25 grade oil) of a reference oil (KV100(ref) and CCSV(ref) respectively) to be combined with the first base stock, and the KV100 and CCSV at the same low temperature of a mixture oil consisting of the reference oil and the first base stock at the desired concentration of the first stock in the mixture oil (KV100(oil) and CCSV(oil), respectively).

Next, if CCSV(oil) is smaller than CCSV(ref), and KV100(oil) is larger than KV100(ref), then the first base stock is determined as a CCSV-reducing base stock at the first concentration.

If CCSV(oil) is smaller than CCSV(ref), and KV100(oil) is smaller than KV100(ref), meaning that the addition of the first base stock into the reference oil results in the decrease of the KV100 compared to the reference oil, then calculate the following values:

$$D(kv) = \frac{KV100(\text{oil}) - KV100(ref)}{KV100(ref)} \times 100; \text{ and}$$

$$D(ccsv) = \frac{CCSV(\text{oil}) - CCSV(ref)}{CCSV(ref)} \times 100.$$

If D(ccsv)/D(kv)≥3.0, then the first base stock is determined as a CCSV-reducing base stock with respect to the reference oil at the first concentration. Those CCSV-reducing base stocks that demonstrate a D(ccsv)≤−5 at a first concentration thereof is considered as a superior CCSV-reducing base stock at the first concentration. In general, for a negative D(ccsv), the larger the absolute value thereof, |D(ccsv)|, is, the more effective it is in reducing CCSV of the mixture oil compared to the reference oil, and the more desirable it is, all other parameters held equal.

The above methodology can be reduced to expression in a x-y coordinate system, where the x-axis is D(kv), and the y-axis is D(ccsv). The two axes cross at (0,0) which represents the reference oil. Thus all first base stocks in the quadrant where $x>0$ and $y<0$ are CCSV-reducing base stocks. All first base stocks in the quadrants where $y>0$ are not CCSV-reducing base stocks because incorporation thereof resulted in increase of the CCSV.

For any first base stock belonging to the quadrant where $x<0$ and $y<0$, if it is on or below the line defined by equation $y=3x$, then it is an CCSV-reducing base stock in the meaning of the present disclosure. Otherwise it is not a CCSV-reducing base stock in the meaning of the present disclosure. Those CCSV-reducing base stocks having a D(ccsv) falling on or below the line defined by $y=-5$ are regarded as superior (preferred) CCSV-reducing base stock at the given concentration thereof. This diagrammatic representation is shown in FIG. 1.

Alternatively, the CCSV-reducing efficacy of a given first base stock can be determined by measuring the high temperature kinematic viscosity at temperatures other than 100° C., e.g., 40° C. Likewise, measurement of the low temperature viscosity can be conducted at temperatures other than −35° C., e.g., −30° C., −25° C., −20° C., −15° C., −10° C., and the like, as long as such temperature is of significance to the oil formulation in question. As mentioned above, SAE J300 imposes minimal CCSV requirements for the different grades of engine oils. For a given SAE J300 engine oil grade, the most preferred temperature at which the CCSV is made is the temperature at which the SAE J300 standard imposes the maximal CCSV requirement.

A first base stock determined to be a CCSV-reducing base stock at a first concentration may be tested for CCSV-reducing efficacy at a second concentration, or even more concentrations. Typically, a CCSV-reducing base stock demonstrates higher CCSV-reducing efficacy at higher concentrations in the mixture oil. Thus, if a CCSV-reducing base stock exhibits a $D(ccsv)\leq-5$ at a concentration of 5 wt % thereof based on the total weight of the mixture oil, then it is regarded as an overall superior (preferred) CCSV-reducing base stock. It is expected that an overall superior CCSV-reducing base stock will be a superior CCSV-reducing base stock at higher concentrations thereof in the mixture oil, such as at 6, 7, 8, 9, 10, 11, 12, 13, 14, 14.5 wt %. Such CCSV-reducing base stock having CCSV-reducing efficacy, particularly a high CCSV-reducing efficacy characterized by a high |D(ccsv)| across a large range of concentrations are particularly desirable. Preferably, an overall superior CCSV-reducing base stock demonstrates a D(ccsv) at 5 wt % concentration thereof in the mixture oil of no larger than −8, −10, −12, −15, −16, −18, −20, −25, −30, −35, −40, −45, −50, −60, −70, −80, −90, −100, −200, −500, −800, or even −1000. Certain highly advantageous CCSV-reducing base stock of the present disclosure may demonstrate a $D(ccsv)\geq5$ even at concentrations such as 1, 2, 3, 4 wt %, based on the total weight of the mixture oil. A first base stock found to be a CCSV-reducing base stock in a first reference oil is a good indicator that it will also be a CCSV-reducing base stock in a different, second reference oil with similar chemical composition to that of the first reference oil.

Preferably, the mixture oil consisting of the reference oil and the first base stock found to be a CCSV-reducing base stock is the interested lubricating oil.

In real life, the reference oil may be chosen as a combination of various base stocks of the final lubricating oil formulation. Once it is determined that the mixture oil consisting of the reference oil and the first base stock have the desired CCSV and KV100, one can then add additional components, such as additive packages typically used for the type of lubricating oil in question, to make the final lubricating oil.

Still it is possible that one may use a particular base stock used in the final formulation of the lubricating oil as the reference oil. Such base stock reference oil desirably can be the base stock having the closest KV100 to that of the first base stock, i.e., the CCSV-reducing base stock, among all the base stocks contained in the lubricating oil formulation other than the first base stock. Alternatively, such base stock reference oil desirably can be the base stock having the closest CCSV(ref) at the given interested temperature to that of the first base stock among all the base stocks contained in the formulation other than the first base stock. For engine oil formulations, a commercial Group IV base stock, such as a conventionally catalyzed (i.e., non-metallocene-catalyzed) PAO having a KV100 of about 4 cSt ("PAO-4", such as SpectraSyn™ 4 commercially available from ExxonMobil Chemical Company having an address at 4500 Bayway Drive, Baytown, Tex., U.S.A.), may be used as the reference oil.

Furthermore, it is also possible that one may add additional base stocks into the mixture oil consisting of the reference oil and the first base stock, preferably at small quantities, to fine-tune the final lubricating oil formulations to the desired chemical composition with the optimal properties such as KV100 and CCSV. Desirably such KV100 and CCSV meet the requirements of a SAE J300 grade designation for an engine oil, particularly a 0W20, 0W30, 0W40, 5W20, 5W30, 5W40, 10W20, 10W30, 10W40, 15W20, 15W30, 15W40, 20W20, 20W30, or 20W40, grade oil.

Of course, once the final oil formulation is determined, one can form the product by mixing the various components in any order as appropriate to one having ordinary skill in the art. For example, the first base stock, the various components of the reference oil, and the various additives and additional components can be all mixed at the same time to obtain the oil formulation product, bypassing the step of forming the mixture oil of the first base stock and the reference oil. Furthermore, one may substitute the reference oil with a similar base stock or base stock mixture (e.g., those having a KV100 in the range from f1*KV100(ref) to f2*KV100(ref), where f1 and f2 can be, independently, 0.5, 0.6, 0.7, 0.8, 0.9, 1.0, 1.2, 1.3, 1.4, 1.5, 1.6, 1.7, 1.8, 1.9, 2.0, as long as $f1<f2$, and in the same API Group as the reference oil) in the lubricating oil formulation, knowing that the CCSV-reducing first base stock would behave similarly in mixtures with those substitute oils for the reference oils.

III. The Oil Composition Containing the CCSV-Reducing Base Stock

III.1 General

The CCSV-reducing base stocks of this disclosure are useful in formulating lubricating oils. The oil composition of the first aspect of the present disclosure summarized above can be a portion or the entirety of a lubricating oil formulation. Thus, the oil composition can be: (i) a mixture of the first base stock and the remainder of the formulation absent the first base stock; (ii) a mixture of the first base stock with one or more other base stocks contained in the lubricating oil formulation absent the additive components in the lubricating oil formulation; (iii) a mixture of the first base stock and all other base stocks contained in the lubricating oil formulation but absent any additive components that may be present in the lubricating oil formulation; (iv) a mixture of the first base stock and one or more other base stocks, but not all the other base stocks, contained in the lubricating oil formulation, and at least a portion of the additive components contained in the lubricating oil formulation; and (v) a mixture of the first base stock and all additive components contained in the lubricating oil formulation, but no other base stocks contained in the lubricating oil formulation.

Therefore, to make a final lubricating oil formulation of a product, one may add additional components, such as other base stocks, additional quantities of the materials already present in the oil composition, additive components, and the like to the oil composition of the present disclosure. A particularly preferred embodiment of the oil composition of the present disclosure, however, is a lubricating oil formulation, in which case the reference oil is the remainder of the lubricating oil formulation absent the first base stock.

The oil composition (preferably, a lubricating oil formulation) has a KV100 of KV100(oil) and a CCSV at a given low temperature discussed above of CCSV(oil); the reference oil having a chemical composition of the remainder of the oil composition absent the first base stock has a KV100 and CCSV of KV100(ref) and CCSV(ref), respectively, and the following conditions (i) and (ii) are met:

$$d1 \le D(kv) = \frac{KV100(\text{oil}) - KV100(ref)}{KV100(ref)} \times 100 \le d2, \quad \text{(i)}$$

where d1 and d2 can be, independently, −20, −18, −16, −15, −14, −12, −10, −8, −6, −5, −4, −2, 0, 2, 4, 6, 8, 10, 12, 14, 15, 16, 18, 20, 22, 24, 25, 26, 28, 30, 32, 34, 36, 38, 40, as long as d1<d2; preferably d1=−10, and d2=20; and $$d3 \le D(ccsv) = \frac{CCSV(\text{oil}) - CCSV(ref)}{CCSV(ref)} \times 100 < d4, \quad \text{(ii)}$$

where d3 and d4 can be, independently, −1000, −800, −600, −500, −400, −200, −100, −80, −60, −50, −48, −46, −45, −44, −42, −40, −30, −38, −36, −35, −34, −32, −30, −28, −26, −25, −24, −22, −20, −18, −16, −15, −14, −12, −10, −8, −6, −5, −4, −2, as long as d3<d4; preferably d3=−100, and d4=−5; more preferably d3=−50, and d4=−10.

In one preferred embodiment, the following conditions (i) and (ii) are met:

(i) d5≤D(kv)≤d6, where d5 and d6 can be, independently, 0, 1, 2, 3, 4, 5, 6, 7, 8, 9, 10, 12, 14, 15, 16, 18, 20, 25, 30, 35, 40, as long as d5<d6; preferably d5=1, and d6=20; more preferably d5=2, and d6=15; and (ii) d7≤D(ccsv)≤d8, where d7 and d8 can be, independently, −1000, −800, −600, −500, −400, −200, −100, −80, −60, −50, −48, −46, −45, −44, −42, −40, −30, −38, −36, −35, −34, −32, −30, −28, −25, −22, −20, −18, −16, −15, −14, −12, −10, −8, −6, −5, −4, −3, −2, or −1, as long as d7<d8; preferably d7=−100, and d8=−3; more preferably d7=−50, and d8=−5.

In these embodiments, inclusion of the CCSV-reducing base stock into the formulation resulted in the decrease of CCSV in the formulation compared to the reference oil, and an increase of or maintenance of KV100 in the formulation compared to the reference oil, both are highly desired for formulating an engine oil having high wear protection.

In another embodiment, the following conditions (i), (ii), and (iii) are met:

(i) d9≤D(kv)≤d10, where d9 and d10 can be, independently, −0.01, −0.05, −0.1, −0.5, −1, −2, −4, −5, −6, −8, −10, −12, −14, −15, −16, −18, −20, −22, −24, −25, as long as d9<d10; preferably d9=−0.05, and d10=−20; more preferably d9=−0.1, and d10=−10;

(ii) d11≤D(ccsv)≤d12, where d11 and d12 can be, independently, −1000, −800, −600, −500, −400, −200, −100, −80, −60, −50, −48, −46, −45, −44, −42, −40, −30, −38, −36, −35, −34, −32, −30, −28, −26, −25, −24, −22, −20, −18, −16, −15, −14, −12, −10, −8, −6, −5, −4, −2, 0, as long as d11<d12; preferably d11=−30, and d12=−5; more preferably d11=−25, and d12=−10; and (iii) r1≤D(ccsv)/D(kv), preferably but not necessarily D(ccsv)/D(kv)≤r2, where r1 and r2 can be, independently, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 500, 1000, 5000, 10,000, 50,000, as long as r1<r2. Preferably r1=5, more preferably r1=10. Preferably, r2=10,000, more preferably r2=1,000.

In these embodiments, inclusion of the CCSV-reducing base stock into the formulation resulted in the decreases of both CCSV and KV100 in the formulation compared to the reference oil. To achieve an engine oil having high anti-wear protection to the metal surfaces, preferably meeting the classification requirements of SAE J300 for a grade therein, the ratio of D(ccsv)/D(kv) should be desirable high, i.e., at least 3, preferably at least 5, more preferably at least 10.

The CCSV-reducing base stock is preferably present in an amount sufficient for providing desired CCSV-reducing effect in the oil composition, while balancing other properties of the oil composition, particularly the KV100. The CCSV-reducing base stock can be present in the oil compositions of this disclosure in an amount from about c1 to c2 wt %, based on the total weight or the oil composition, where c1 and c2 can be, independently, 0.1, 0.3, 0.5, 0.6, 0.8, 1.0, 2.0, 3.0, 4.0, 5.0, 6.0, 7.0, 8.0, 9.0, 10.0, 11.0, 12.0, 13.0, 14.0, 14.1, 14.2, 14.3, 14.4, 14.5, 14.6, 14.7, 14.8, or 14.9, as long as c1<c2. Preferably c1=3.0, and c2=14.0. More preferably c1=5.0, and c2=12.0. In general, it is desirable that the oil composition contains the CCSV-reducing base stock as a co-base stock.

Preferred oil compositions of the present disclosure containing the CCSV-reducing base stock exhibit a KV100 in a range from kv1 to kv2, where kv1 and kv2 can be 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, as long as kv1<kv2.

Engine oil lubricant grades are determined pursuant to SAE J300 specifications. The low temperature (W) grades (i.e., 10W-xx, 5W-xx, 0W-xx) are determined by the performance in a combination of viscosity tests including cold crank simulation (CCS) (ASTM D 5293) and low-temperature pumping viscosity (ASTM D 4684). The high temperature grading for an engine oil (i.e., XW-20, XW-30) is determined by kinematic viscosity at 100° C. (ASTM D 445) and high-temp high-shear viscosity (ASTM D 4683).

Advantageously, the use of a CCSV-reducing base stock of the present invention in an engine oil formulation can result in such oil having a particularly desirably high KV100, while maintaining an acceptable CCSV, both within the permitted ranges specified by the SAE J300 grade classifications.

Desirably, the oil composition of the present disclosure is an mW20 engine oil meeting the requirements of SAE J300, where m can be 0, 5, 10, 15, 20, 25, having a KV100 in the range from 7.4 to 9.3 cSt, preferably from 8.4 to 9.3 cSt.

Desirably, the oil composition of the present disclosure is an mW30 engine oil meeting the requirements of SAE J300, where m can be 0, 5, 10, 15, 20, 25, having a KV100 in the range from 10.9 to 12.5 cSt, preferably from 11.7 to 12.5 cSt.

Desirably, the oil composition of the present disclosure is an mW40 engine oil meeting the requirements of SAE J300, where m can be 0, 5, 10, 15, 20, 25, having a KV100 in the range from 14.4 to 16.3 cSt, preferably from 15.4 to 16.3 cSt.

A 5W-20 grade engine oil is allowed a KV100 range from 5.6 to 9.3 cSt. The fuel efficiency offered by the lubricant improves as the KV100 is reduced. In practice, however, it is difficult to approach the KV100 minimum of 5.6 cSt without simultaneously lowering the low temperature CCSV below the 5W limit (6200 centipoise at −35° C.) and into the 0W range. This is particularly true for engine oils that use high-quality Group III/IV base stocks that have very low CCSV. Therefore, conventional attempts to maximize the fuel efficiency of a 5W engine oil by minimizing the KV100 through the strategy of increasing the quantity of the high-quality Group III/IV base stock can result in reclassification of the modified oil as a 0W engine oil. Therefore, there is a practical limit to how low the viscosity of a 5W grade engine oil can be reduced before it is falls out of grade. Likewise, there is a fuel efficiency limit for 5W grade engine oil.

A CCSV-reducing base stock of the present disclosure described above can be used to reduce the low temperature CCSV of a formulation. Ideally, the CCSV-reducing base stock does not decrease the high temperature KV100 viscosity relative to the rest of the engine oil formulation (i.e., the remainder of the oil absent the CCSV-reducing base stock). The incorporation of CCSV-reducing base stock of the present disclosure in an engine oil allows the formulation to maintain the high temperature viscosity while maintaining high enough CCSV to stay in grade.

The oil compositions of the present disclosure containing the CCSV-reducing base stock may advantageously exhibit a VI in the range from about 30 to about 200, preferably from about 35 to about 180, more preferably from about 40 to about 150.

The oil compositions of the present disclosure containing the CCSV-reducing base stock advantageously exhibit a NV value of no greater than 20%, preferably no greater than 18%, 16%, 15%, 14%, 12%, 10%, or even 8%.

The oil compositions of this disclosure are particularly advantageous as engine oil for internal combustion engines, including gas engines, diesel engines, natural gas engines, four-stroke engines, two-stroke engines, and rotary engines. The engine oil can be placed into the crank case of the engine to provide the necessary lubrication and cooling effect for the engine during normal operation. The high KV100, coupled with the CCSV of the oil enabled by the use of the CCSV-reducing base stock makes it particularly protective against wear. The engine oil is particularly advantageous as passenger vehicle engine oil (PVEO) products.

While it is possible the lubricating oil formulation or oil composition of the present disclosure contains the CCSV-reducing base stock as a primary base stock, or even as a single base stock, it is preferable to include the CCSV-reducing base stock as a co-base stock in combination with one primary base stock and optionally one or more additional co-base stocks. In addition to the base stocks, the lubricating oil formulation or oil composition of the present disclosure may further comprise additive components.

III.2 Other Base Stocks Useful in the Lubricating Oil

A wide range of lubricating oil base stocks known in the art can be used in conjunction with the CCSV-reducing base stock in the lubricating oil formulations of the present disclosure, as primary base stock or co-base stock. Such other base stocks can be either derived from natural resources or synthetic, including un-refined, refined, or re-refined oils. Un-refined oil base stocks include shale oil obtained directly from retorting operations, petroleum oil obtained directly from primary distillation, and ester oil obtained directly from a natural source (such as plant matters and animal tissues) or directly from a chemical esterification process. Refined oil base stocks are those un-refined base stocks further subjected to one or more purification steps such as solvent extraction, secondary distillation, acid extraction, base extraction, filtration, and percolation to improve the at least one lubricating oil property. Re-refined oil base stocks are obtained by processes analogous to refined oils but using an oil that has been previously used as a feed stock.

API Groups I, II, III, IV and V are broad categories of base stocks developed and defined by the American Petroleum Institute (API Publication 1509; www.API.org) to create guidelines for lubricant base stocks. Group I base stocks generally have a viscosity index of from about 80 to 120 and contain greater than about 0.03% sulfur and less than about 90% saturates. Group II base stocks generally have a viscosity index of from about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. The table below summarizes properties of each of these five groups.

Base Stock Properties

| | Saturates | Sulfur | Viscosity Index |
|---|---|---|---|
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefms (PAO) products | | |
| Group V | All other base stocks not included in Groups I, II, III or IV | | |

Natural oils include animal oils (e.g. lard), vegetable oils (e.g., castor oil), and mineral oils. Animal and vegetable oils possessing favorable thermal oxidative stability can be used. Of the natural oils, mineral oils are preferred. Mineral oils vary widely as to their crude source, e.g., as to whether they are paraffinic, naphthenic, or mixed paraffinic-naphthenic. Oils derived from coal or shale are also useful in the present disclosure. Natural oils vary also as to the method used for their production and purification, e.g., their distillation range and whether they are straight run or cracked, hydrorefined, or solvent extracted.

Group II and/or Group III base stocks are generally hydroprocessed or hydrocracked base stocks derived from crude oil refining processes.

Synthetic base stocks include polymerized and interpolymerized olefins (e.g., polybutylenes, polypropylenes, propylene isobutylene copolymers, ethylene-olefin copolymers, and ethylene-alphaolefin copolymers).

Synthetic polyalphaolefins ("PAO") base stocks are placed into Group IV. Advantageous Group IV base stocks are those made from one or more of C6, C8, C10, C12, and C14 linear alpha-olefins ("LAO"s). These base stocks can be commercially available at a wide range of viscosity, such as a KV100 in the range from 1.0 to 1,000 cSt. The PAO base stocks can be made by polymerization of the LAO(s) in the presence of Lewis-acid type catalyst, in the presence of a metallocene compound-based catalyst system. High quality Group IV PAO commercial base stocks including the SpectraSyn™ and SpectraSyn Elite™ series available from ExxonMobil Chemical Company having an address at 4500 Bayway Drive, Baytown, Tex. 77450, United States.

All other synthetic base stocks, including but not limited to alkyl aromatics and synthetic esters are in Group V.

Esters in a minor amount may be useful in the lubricating oil formulations of this disclosure. Additive solvency and seal compatibility characteristics may be imparted by the use of esters such as the esters of dibasic acids with monoalkanols and the polyol esters of monocarboxylic acids. Esters of the former type include, e.g., the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc. Useful ester-type Group V base stock include the Esterex™ series commercially available from ExxonMobil Chemical Company.

One or more of the following maybe used as a base stock in the lubricating oil of the present disclosure as well: (1) one or more Gas-to-Liquids (GTL) materials; and (2) hydrodewaxed, hydroisomerized, solvent dewaxed, or catalytically dewaxed base stocks derived from synthetic wax, natural wax, waxy feeds, slack waxes, gas oils, waxy fuels, hydrocracker bottoms, waxy raffinate, hydrocrackate, thermal crackates, foots oil, and waxy materials derived from coal liquefaction or shale oil. Such waxy feeds can be derived from mineral oils or non-mineral oil processing or can be synthetic (e.g., Fischer-Tropsch feed stocks). Such base stocks preferably comprise linear or branched hydrocarbyl compounds of C20 or higher, more preferably C30 or higher.

The lubricating oil formulations or oil compositions of the present disclosure can comprise one or more Group I, II, III, IV, or V base stocks in addition to the CCSV-reducing base stock. Preferably, Group I base stocks, if any, is present at a relatively low concentration if a high quality lubricating oil is desired. Group I base stocks may be introduced as a diluent of an additive package at a small quantity. Groups II and III base stocks can be included in the lubricating oil formulations or oil compositions of the present disclosure, but preferably only those with high quality, e.g., those having a VI from 100 to 120. Group IV and V base stocks, preferably those of high quality, are desirably included into the lubricating oil formulations or oil compositions of the present disclosure.

III.3 Lubricating Oil Additives

The formulated lubricating oil useful in the present disclosure may additionally contain one or more of the commonly used lubricating oil performance additives including but not limited to dispersants, detergents, viscosity modifiers, antiwear additives, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, densifiers, wetting agents, gelling agents, tackiness agents, colorants, and others. For a review of many commonly used additives and the quantities used, see: (i) Klamann in Lubricants and Related Products, Verlag Chemie, Deerfield Beach, Fla.; ISBN 0-89573-177-0; (ii) "Lubricant Additives," M. W. Ranney, published by Noyes Data Corporation of Parkridge, N.J. (1973); (iii) "Synthetics, Mineral Oils, and Bio-Based Lubricants," Edited by L. R. Rudnick, CRC Taylor and Francis, 2006, ISBN 1-57444-723-8; (iv) "Lubrication Fundamentals", J. G. Wills, Marcel Dekker Inc., (New York, 1980); (v) Synthetic Lubricants and High-Performance Functional Fluids, 2nd Ed., Rudnick and Shubkin, Marcel Dekker Inc., (New York, 1999); and (vi) "Polyalphaolefins," L. R. Rudnick, Chemical Industries (Boca Raton, Fla., United States) (2006), 111 (Synthetics, Mineral Oils, and Bio-Based Lubricants), 3-36. Reference is also made to: (a) U.S. Pat. No. 7,704,930 B2; (b) U.S. Pat. No. 9,458,403 B2, Column 18, line 46 to Column 39, line 68; (c) U.S. Pat. No. 9,422,497 B2, Column 34, line 4 to Column 40, line 55; and (d) U.S. Pat. No. 8,048,833 B2, Column 17, line 48 to Column 27, line 12, the disclosures of which are incorporated herein in its entirety. These additives are commonly delivered with varying amounts of diluent oil that may range from 5 wt % to 50 wt % based on the total weight of the additive package before incorporation into the formulated oil. The additives useful in this disclosure do not have to be soluble in the lubricating oil formulations. Insoluble additives in oil can be dispersed in the lubricating oil formulations of this disclosure.

When lubricating oil formulations contain one or more of the additives discussed above, the additive(s) are blended into the oil composition in an amount sufficient for it to perform its intended function.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil formulation.

Examples of techniques that can be employed to characterize the CCSV-reducing base stock described above include, but are not limited to, analytical gas chromatography, nuclear magnetic resonance, thermogravimetric analysis (TGA), inductively coupled plasma mass spectrometry, differential scanning calorimetry (DSC), and volatility and viscosity measurements.

The present invention is further illustrated by the following non-limiting examples.

EXAMPLES

In the following examples, including inventive and comparative examples, the candidate base stocks were evaluated for CCSV-reducing efficacy with respect to a commercial Group IV base stock as the reference oil using the methodology described above. The reference oil has a KV100 of about 4 and is called PAO-4 (SpectraSyn™ 4 from ExxonMobil Chemical Company). Other commercial Group IV base stocks, such as PAO-6, PAO-8, PAO-40, and PAO-100 mentioned in the examples have KV100 in the vicinity of 6, 8, 40, and 100 cSt, respectively. CCSV-reducing efficacy of the candidate base stocks can be evaluated likewise with respect to PAO-6, PAO-8, PAO-40, and PAO-100, or any mixtures of two or more of PAO-4, PAO-6, PAO-8, PAO-40, and PAO-100, as reference oils. Due to the similarity among PAO-4, PAO-6, and PAO-8, it is probable that the candidate CCSV-reducing base stocks would demonstrate similar CCSV-reducing behavior with respect to PAO-6 and PAO-8, or any mixtures of two or more of PAO-4, PAO-6, and PAO-8. All CCSV values in the inventive and comparative examples were measured at −35° C. pursuant to ASTM D5583.

Example 1

Figure 2:
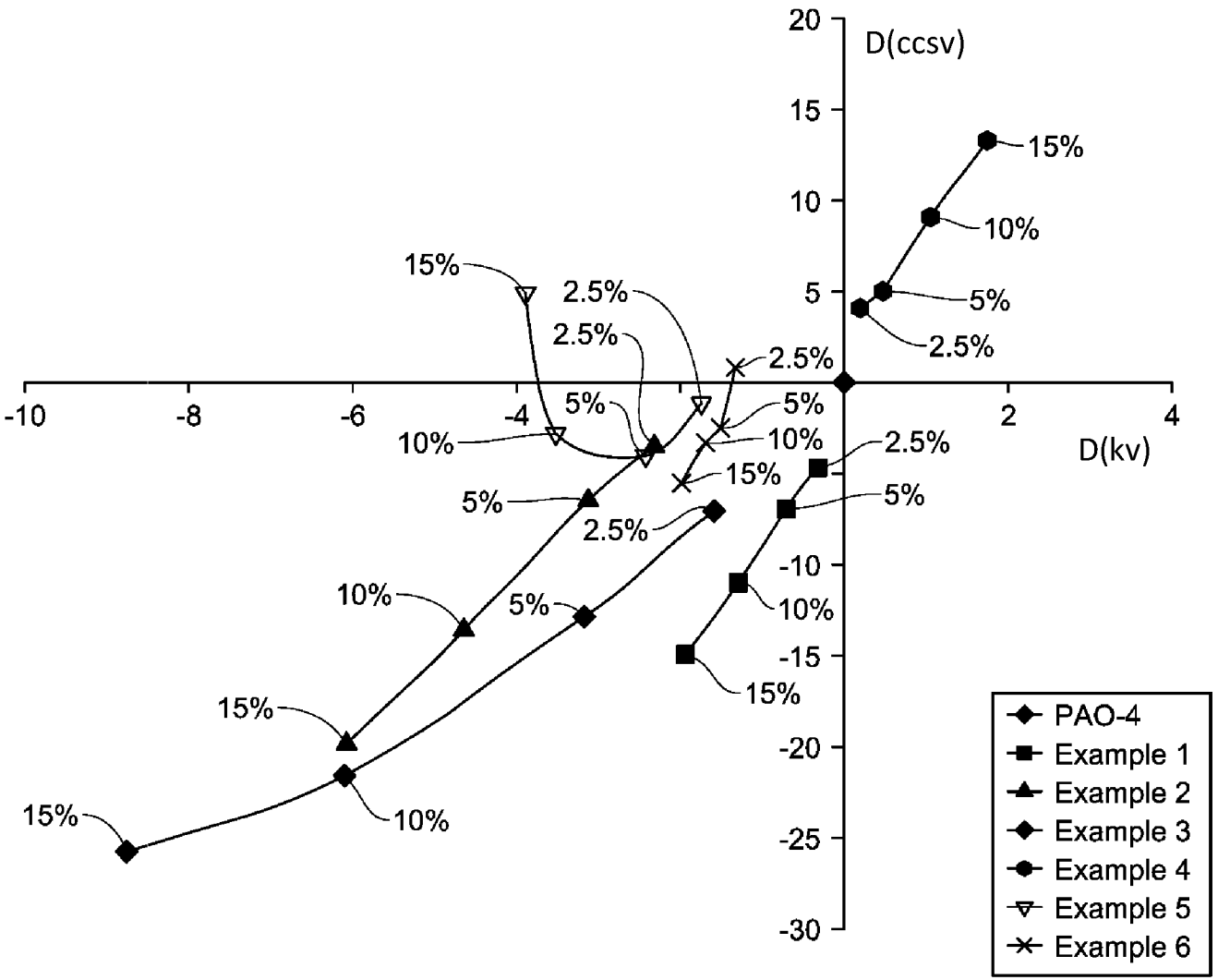
FIG. 2 graphically shows CCSV-reducing efficacies of various mono-ester base stocks and comparative esters.

2-Octyldodecyl dodecanoate derived from a Guerbet alcohol (i.e., 2-octyl-1-dodecanol) and a linear acid (i.e., decanoic acid, a linear C12 carboxylic acid) demonstrated excellent CCSV-reducing efficacy when blended at low treat rate with PAO-4 as the reference oil. As shown in FIG. 2, 2-octyldodecyl dodecanoate demonstrated a negative D(ccsv)<−5% when blended at various treat rates in the range from 5 to 15 wt %, based on the total weight of the binary mixture oil of PAO-4 and the mono-ester. Although a negative D(kv) (i.e., a decrease of KV100 from the reference oil) was observed, the ratio D(ccsv)/D(kv)>3 is quite high, making it a highly effective CCSV-reducing base stock without significantly impacting the KV100 of the mixture oil.

Example 2

2-Octyldodecyl nonanoate derived from a Guerbet alcohol (i.e., 2-octyl-1-dodecanol) and a linear acid (i.e., nonanoic acid, a linear C9 carboxylic acid) demonstrated excellent CCSV-reducing efficacy when blended at low treat rate with PAO-4 as the reference oil. As shown in FIG. 2, 2-octyldodecyl nonanoate demonstrated a negative D(ccsv) <−5% when blended at various treat rates in the range from 5 to 15 wt %, based on the total weight of the binary mixture oil of PAO-4 and the mono-ester. Although a negative D(kv) (i.e., a decrease of KV100 from the reference oil) was observed, D(ccsv)/D(kv)>3 is quite high, making it a highly effective CCSV-reducing base stock without significantly impacting the KV100 of the mixture oil.

Example 3 (Comparative)

Di-iso-octyl adipate derived from iso-octyl alcohol and adipic acid (Esterex™ A32, a commercial Group V ester-type base stock available from ExxonMobil Chemical Company having an address at 4500 Bayway Drive, Baytown, Tex. 77450, United States) demonstrated CCSV-reducing efficacy as shown in FIG. 3. However, the high Noack volatility (>30%) of this di-ester precludes this ester from being an inventive example of a CCSV-reducing base stock. As shown by this example, it is possible to reduce the CCSV of a formulation simply by including an ester of low molecular weight such as Esterex™ A32. However, the high NV value of such an ester renders it unsuitable for an engine oil formulation. On the contrary, the CCSV-reducing mono-esters of this disclosure have a NV value of no higher than 20%, preferably no higher than 15%, still more preferably no higher than 10%.

Example 4 (Comparative)

Di-iso-tridecyl adipate derived from iso-tridecyl alcohol and adipic acid (Esterex™ A51, a commercial Group V ester-type base stock available from ExxonMobil Chemical Company) did not demonstrate CCSV-reducing efficacy as shown in FIG. 3.

Example 5 (Comparative)

Di-n-nonyl phthalate derived from a linear C9 alcohol and phthalic acid (Jayflex™ L9P, a commercial Group V ester-type base stock available from ExxonMobil Chemcial Company) did not demonstrate CCSV-reducing efficacy as shown in FIG. 2.

Example 6 (Comparative)

An ester derived from trimethylpropanol and a linear C8/C10 acid (Esterex™ NP343, a commercial Group V ester-type base stock available from ExxonMobil Chemical Company) demonstrated CCSV-reducing efficacy, only at higher treat rates (i.e., 15 wt % in PAO-4), as shown in FIG. 2. However, this ester is a polyol ester.

Properties of the esters of Examples 1-6 are shown in Table 1 below.

TABLE 1

| | Example No. | | | | | |
|---|---|---|---|---|---|---|
| | 1 | 2 | 3 | 4 | 5 | 6 |
| Acid | Linear C12 | Linear C9 | Adipic | Adipic | Phthalate | Linear C8/C10 |
| Alcohol | 2-octyl-1-dodecanol | 2-octyl-1-dodecanol | Iso-octyl | Iso-tridecyl | Linear C9 | Trimethyl propanol |
| Mw (g · mol$^{-1}$) | 452.81 | 410.73 | 370.57 | 510.84 | 418.62 | 554.85 |
| Ester Type | Mono | Mono | Di | Di | Di | Tri |
| KV100 (cSt) | 3.8 | 3.1 | 2.8 | 5.4 | 4.2 | 4.3 |
| KV40 (cSt) | 14.7 | 11.5 | 9.5 | 27 | 22.1 | 19 |
| VI | 157 | 143 | 149 | 136 | 84 | 136 |
| NV (%) | 10 | 13.5 | 30.3 | 7.4 | 10 | 4.6 |
| Oxygen/Carbon Ratio | 0.067 | 0.074 | 0.182 | 0.125 | 0.154 | 0.182 |

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. An oil composition consisting of a first base stock and a reference oil, wherein:

the first base stock comprises 2-octyldodecyl dodecanoate, 2-octyldodecyl nonanoate, or mixtures thereof;

the first base stock is present in the oil composition at a concentration in a range from 0.5 wt % to 14.5 wt %, based on the total weight of the oil composition;

the oil composition has a kinematic viscosity at 100° C. pursuant to ASTM D445 ("KV100") of KV100(oil) and a cold cranking simulator viscosity at a given temperature pursuant to ASTM 5293 ("CCSV") of CCSV(oil);

the reference oil has a KV100 and CCSV of KV100(ref) and CCSV(ref), respectively, the reference oil is the remainder of the oil composition absent the first base stock, and the following conditions (i), (ii), and (iii) are met:

$$-20 \le D(kv) = \frac{KV100(\text{oil}) - KV100(ref)}{KV100(ref)} \times 100 \le 40; \quad \text{(i)}$$

$$-1000 \le D(ccsv) = \frac{CCSV(\text{oil}) - CCSV(ref)}{CCSV(ref)} \times 100 < 0; \quad \text{(ii)}$$

and (iii) D(ccsv)/D(kv)≥3.

2. The oil composition of claim 1, wherein the KV100 and CCSV of the oil composition meets the requirements for a SAE engine oil grade pursuant to SAE J300 viscosity grade classification system.

3. The oil composition of claim 1, wherein the first base stock has a KV100 in the range from 3 to 6 cSt, a Noack volatility pursuant to ASTM D5800 ("NV") of at most 20%, and a viscosity index as determined according to ASTM D2271 ("VI") of a least 100.

4. The oil composition of claim 1, wherein the first base stock is present at a concentration in the range from 1 to 10 wt %, based on the total weight of the oil composition.

5. The oil composition of claim 1, comprising an API Group III base stock and/or a Group IV base stock in the reference oil.

6. The oil composition of claim 1, further comprising one or more of the following additives in the reference oil: dispersants, detergents, viscosity modifiers, antiwear additives, corrosion inhibitors, rust inhibitors, metal deactivators, extreme pressure additives, anti-seizure agents, viscosity modifiers, defoamants, demulsifiers, and wetting agents.

7. The oil composition of claim 1, which is a SAE 0W engine oil, a SAE 5W engine oil, a SAE 10W engine oil, a SAE 15W engine oil, a SAE 20W engine oil, or a SAE 25W engine oil.

8. The oil composition of claim 7, which has a KV100 from 7.4 to 9.3 cSt.

9. The oil composition of claim 1, wherein:

the following conditions (i) and (ii) are met:

(i) −10≤D(kv)<0;

(ii) −1000≤D(ccsv)≤−5.

10. The oil composition of claim 1, wherein:

the following conditions (i) and (ii) are met:

(i) 0.05≤D(kv)≤20; and (ii) −1000≤D(ccsv)≤−5.

11. A process comprising:

obtaining a mono-ester as a first base stock that comprises 2-octyldodecyl dodecanoate, 2-octyldodecyl nonanoate, or mixtures thereof; and using the first base stock in a lubricating oil composition at a concentration thereof in the range from 0.5 to 14.5 wt % based on the total weight of the lubricating oil composition;

wherein the lubricating oil formulation has a KV100 of KV100(oil) and a CCSV of CCSV(oil); and wherein a reference oil which is the remainder of the lubricating oil composition absent the first base stock has a KV100 of KV100(ref) and a cold crank simulator viscosity at a given temperature pursuant to ASTM D5293 ("CCSV") of CCSV(ref), and the following conditions (i), (ii), and (iii) are met:

$$-20 \le D(kv) = \frac{KV100(\text{oil}) - KV100(ref)}{KV100(ref)} \times 100 \le 40; \quad \text{(i)}$$

$$-1000 \le D(ccsv) = \frac{CCSV(\text{oil}) - CCSV(ref)}{CCSV(ref)} \times 100 < -5; \quad \text{(ii)}$$

and (iii) D(ccsv)/D(kv)≥3.

12. The process of claim 11, wherein the first base stock has a kinematic viscosity at 100° C. as determined pursuant to ASTM D445 ("KV100") in the range from 3 to 6 cSt, a Noack volatility pursuant to ASTM D5800 ("NV") of at most 20%, and a viscosity index as determined according to ASTM D2271 of at least 100.

13. The process of claim 11, wherein the first base stock is present at a concentration in a range from 1 to 10 wt %, based on the total weight of the lubricating oil formulation.

14. The process of claim 11, wherein: 0<D(kv)≤20.

15. The process of claim 11, wherein:

the following conditions (i) and (ii) are met:

(i) −20≤D(kv)<0;

(ii) −1000≤D(ccsv)≤5.

16. A method for improving fuel efficiency and/or wear protection in an engine, comprising:

obtaining the oil composition of claim 1, lubricating the engine by an engine oil comprising the oil composition of claim 1.

17. The oil composition of claim 7, which has a KV100 from 10.9 to 12.5 cSt.

18. The oil composition of claim 7, which has a KV100 from 14.4 to 16.3 cSt.

* * * * *